US005692848A

United States Patent [19]

Wada

[11] Patent Number: 5,692,848

[45] Date of Patent: Dec. 2, 1997

[54] RING BINDER

[75] Inventor: Takao Wada, Osaka, Japan

[73] Assignee: Kokuyo Co., Ltd., Osaka, Japan

[21] Appl. No.: 663,262

[22] PCT Filed: Jan. 26, 1996

[86] PCT No.: PCT/JP96/00174

§ 371 Date: Sep. 16, 1996

§ 102(e) Date: Sep. 16, 1996

[87] PCT Pub. No.: WO97/06015

PCT Pub. Date: Feb. 20, 1997

[30] Foreign Application Priority Data

Aug. 9, 1995 [JP] Japan ..... 7-203505

[51] Int. Cl.[6] ..... B42F 13/22

[52] U.S. Cl. ..... 402/39; 402/36; 402/37; 402/41; 402/20; 402/31; 281/27.1

[58] Field of Search ..... 402/31, 36, 37, 402/38, 39, 5, 6, 41, 45, 60, 69, 19–23, 29; 281/27.1, 27.2, 16, 28, 15.1, 21.1

[56] References Cited

U.S. PATENT DOCUMENTS

| | | | |
|---|---|---|---|
| 745,372 | 12/1903 | Northcott et al. | 402/36 |
| 1,097,391 | 5/1914 | Couch | 402/41 X |
| 1,231,816 | 7/1917 | Vesterling | 402/41 X |
| 1,468,845 | 9/1923 | Trussell | 402/38 |
| 1,529,454 | 2/1925 | Trussell | 402/38 |
| 1,813,599 | 7/1931 | Adams | 402/37 |
| 2,715,906 | 8/1955 | Lucchesi | 402/20 |
| 3,995,961 | 12/1976 | Dorfman et al. | 402/20 X |
| 4,815,882 | 3/1989 | Ohminato | 402/20 X |
| 5,018,896 | 5/1991 | Vanni | 281/27.1 X |
| 5,028,159 | 7/1991 | Amrich et al. | 402/20 |
| 5,158,386 | 10/1992 | Mann | 402/41 |
| 5,286,128 | 2/1994 | Gillum | 402/31 X |
| 5,393,156 | 2/1995 | Mullin et al. | 402/31 X |

FOREIGN PATENT DOCUMENTS

| | | | |
|---|---|---|---|
| 2540340 | 4/1977 | Germany | 402/31 |
| 258806 | of 1928 | Italy | 402/39 |

*Primary Examiner*—Daniel W. Howell
*Assistant Examiner*—Julie A. Krolikowski
*Attorney, Agent, or Firm*—Banner & Witcoff, Ltd.

[57] ABSTRACT

In this ring binder, a pair of opposing swing base plates 3 are connected together at two locations near the center of their longitudinal swinging edges 3*a* by means of a joint mechanism 6 through operative engagement between the recessed joint section 61 having a projection 63 and the extended joint section 62 having a slot 64, so that the opposing swing base plates 3 are pivotally movable together in unison, and the swinging edges 3*a* are pivotally movable together toward and away from the top face 21*a* of the recessed section 21 in the fixed base plate 2.

4 Claims, 10 Drawing Sheets

RING BINDER

TECHNICAL FIELD

This invention relates to a ring binder for removably binding separate sheets with binding holes by opening and closing binding rings.

BACKGROUND ART

In one of the known prior-art designs of this type of the ring binder, a pair of opposing swing plates are pivotally attached to the longitudinal edges of a fixed plate by means of a hinge mechanism, and a pair of opposing ring halves which form a binding ring are fixedly mounted at their bases onto the swing plates. As the longitudinal swing edges of the opposing swing plates are moved toward the top face of the fixed plate, the ring halves are brought into engagement with each other at their ends, thereby closing the binding ring. Also, the hinge mechanisms on the swing plates is normally provided with a coil spring for resiliently biasing the swing plates away from the top face of the fixed plate.

In order to close the binding rings in this type of the ring binder, the opposing swing plates are separately rotated until their swing edges come closer to the top face of the fixed plate, thus bringing the ends of the ring halves into engagement with each other. When it is intended to open the binding rings, after disengaging the ends of the opposing ring halves, the swing plate are rotated so that their swing edges move away from the top of the fixed plate.

However, with this arrangement of the ring binder, the opening and closing operations are rather complicated.

Since the opposing swing plates are independently hinged to the fixed plate, it is necessary to rotate the opposing swing plates separately by hand manipulation, making one-touch operation by one hand difficult. Moreover, the coil spring must be incorporated into each of the hinge mechanisms for the opposing swing plates, which increases the number of necessary parts. In addition, in order to achieve stable engagement between the ends of the ring halves, the opposing swing plates must be precisely mounted. But for the swing plates to be able to pivotally rotate, some free play in a longitudinal direction must be allowed, and so are the mounting tolerance. Thus with arrangement of the prior-art ring binder, the ends of the opposing ring halves inevitably clash against each other, making it difficult to accomplish stable engagement of the ring halves.

DISCLOSURE OF INVENTION

It is the object of the invention to eliminate these and other disadvantages of the prior-art, and to achieve the object, the following arrangement has been designed.

The ring binder in accordance with this invention includes a fixed plate, a pair of opposing swing plates pivotally attached to the longitudinal edges of the fixed plate by means of a hinge mechanism, and binding rings fixedly mounted on the swing plates. As the swinging edges of the opposing swing plates are pivotally moved closer toward the top face of the fixed plate, the binding rings are closed, while, on the other hand, as the swinging edges of the opposing swing plates are moved pivotally away from the top of the fixed plate, the binding rings are opened. The swinging edges of the opposing swing plates are uniquely connected together by a joint mechanism so that the opposing swing plates are moved pivotally together toward and away from the top face of the fixed plate.

In one preferred embodiment, the joint mechanism may include a male joint having a projection fixedly mounted to the swinging edge of one swing plate, and a female joint fixedly mounted to the swinging edge of the other swing plate at a position corresponding to the male joint and having a slot extending along the width at a position corresponding to the projection. With this arrangement, the male joint and the female joint are engaged together by means of the projection being slidably fitted into the slot, thus connecting the swinging edges of the opposing swing plates together. In another form, the joint mechanism may include a protruded joint section formed on the swing edge of one swing plate, and a recessed joint section formed on the swing edge of the other swing plate. As the swing plates are pivotally moved together toward and away from the fixed plate, the protruded joint section slides into the recessed joint section. In still another form, the joint mechanism may include a male joint formed in the side face of the recessed joint section, and a female joint formed in the side face of the protruded joint section at a position corresponding to the male joint, or a male joint formed in the side face of the protruded joint section and a female joint formed in the side face of the recessed joint section at a position on corresponding to the male joint.

In one form of the embodiment, the hinge mechanism may include spring means only in that hinge mechanism provided on one swing plate for resiliently biasing the swinging edge of the swing plate away from the top face of the fixed plate.

In one form of the embodiment, the binding ring may include opposing ring halves fixedly mounted at their bases near the bottom edges of the swing plates, and having formed at their ends locking portions. As the ring halves are closed, the ring halves are joined together at their locking ends.

The ring binder of the above-described arrangement operates in use as follows. When it is intended to close the binding rings, pivotally move only one swing base plate to bring its swing edge closer toward the top face of the fixed plate, which simultaneously brings the swinging edge of the other swing plate closer toward the top face of the fixed plate by means of the joint mechanism, thus closing the binding rings. On the other hand, when it is intended to open the binding rings, pivotally move only one swing base plate to bring its swing edge away from the top face of the fixed plate, which simultaneously brings the swinging edge of the other swing plate away from the top face of the fixed plate by means of the joint mechanism, thus opening the binding rings. In this manner, as the opposing swing plates pivotally move together via operative engagement by the joint mechanisms, it is only necessary to manipulate either one of the swing plates for the closing and opening of the binding rings, making an one-touch operation possible with greater ease of operation.

With the arrangement of the joint mechanisms, the swinging edges of the opposing swing plates are connected together by slidably fitting the projection of the male joint into the slot of the female joint. This simple construction is effectively achieve the above advantages while making it possible to reduce both manufacturing costs and manufacturing processes. The arrangement in which the protruded joint section slidably move within the recessed joint section as the swing plates pivotally move is effective in reducing the longitudinal offset in the position of the swing plates by means of the operative engagement between the side faces of the recessed joint section and the side faces of the protruded joint section, which, in turn, ensures a steady opening and closing operation of the binding rings even if the mounting accuracy of the swing plates is rather low.

Also, by providing the male joint and the female joint in the recessed joint section and the protruded joint section, respectively, or in the protruded joint section and the recessed joint section, respectively, it is possible to achieve the above advantages with the simplest arrangement.

Because the opposing pair of the swing plates pivotally move together in unison when they are spring biased, it is only necessary to spring-bias by the hinge mechanism provided on one of the swing plates, which enables to reduce the number of spring means less than the prior-art construction.

Moreover, the binding rings are so designed that the opposing pair of ring halves be locked together at their locking ends, eliminating the need for the joint mechanism to keep the binding rings in their closed position, which in turn leads to a simple construction of the joint mechanism as well as to an improved operation.

As hereinabove explained, in accordance with the present invention, it is only necessary to manipulate either one of the swing plates for the closing and opening of the binding rings, making an one-touch operation possible with greater ease of operation.

With the arrangement of the joint mechanisms, the swinging edges of the opposing swing plates are connected together by slidable engagement between the male joint and the female joint. This simple construction is effectively achieve the above advantages while making it possible to reduce both manufacturing costs and manufacturing processes. The arrangement in which the protruded joint section slidably move within the recessed joint section as the swing plates pivotally move is effective in reducing the longitudinal offset in the position of the swing plates, which, in turn, ensures a steady opening and closing operation of the binding rings even if the mounting accuracy of the swing plates is rather low. Also, by providing the male joint and the female joint in the recessed joint section and the protruded joint section, respectively, or in the protruded joint section and the recessed joint section, respectively, it is possible to achieve the above advantages with the simplest arrangement. Moreover, it is only necessary to spring-bias by the hinge mechanism provided on one of the swing plates, which enables to reduce the number of spring means less than the prior-art construction. In addition, the binding rings are so designed that the opposing pair of ring halves be locked together at their locking ends, eliminating the need for the joint mechanism to keep the binding rings in their closed position, which in turn leads to a simple construction of the joint mechanism as well as to an improved operation.

As is apparent from the foregoing description, the present invention has distinguished advantages of enabling the one-touch operation with a simple construction, leading to an improved operation.

BEST MODE FOR CARRYING OUT THE INVENTION

Figure 1:
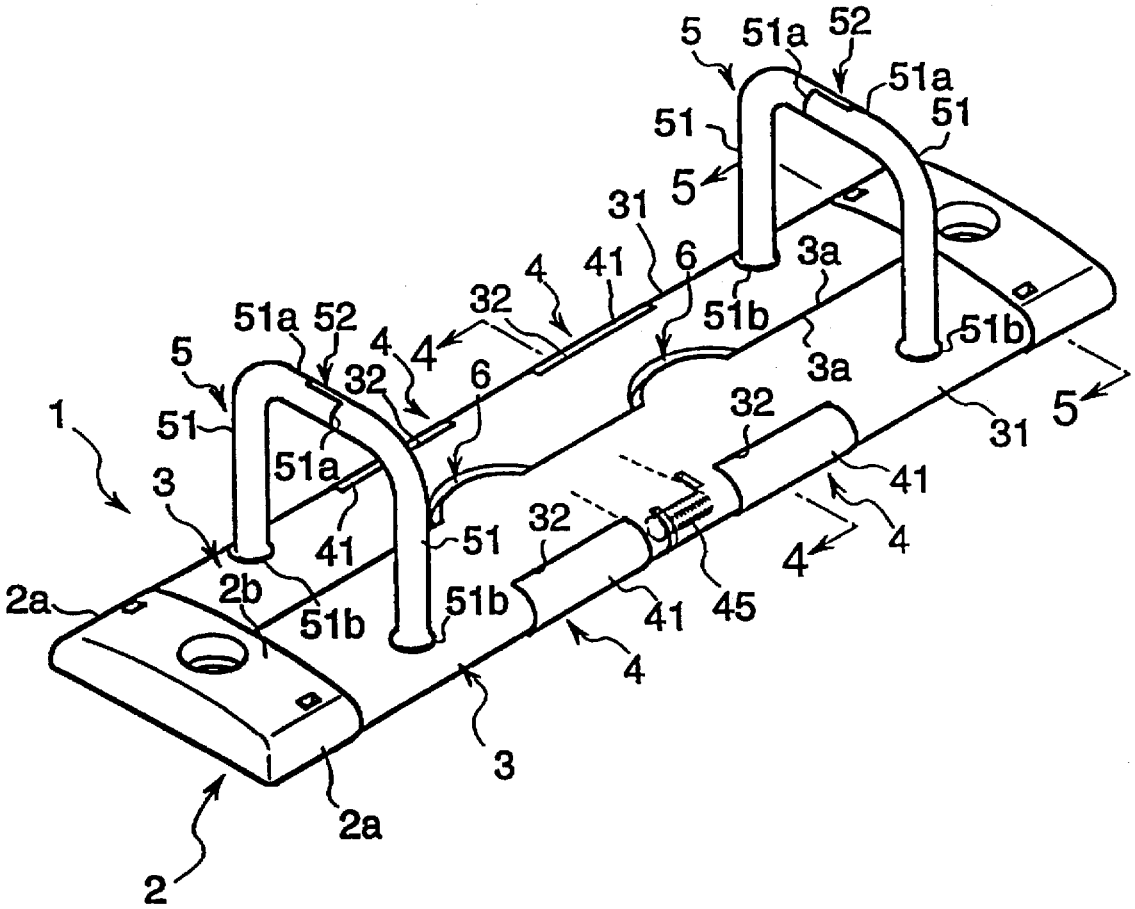
FIG. 1 is a perspective view showing one embodiment of the present invention.

The ring binder 1 shown in FIGS. 1–7 is made, for example, of plastic material, and, as illustrated in FIG. 1, comprises a pair of swing base plates 3 which are joined for swinging motion to the longitudinal edges 2*a* of a fixed base plate 2 by means of a hinge mechanism 4, so that the swinging movement of the swing base plates 3 will cause the binding rings 5 attached to the swing base plates 3 to be opened and closed.

Figure 2:
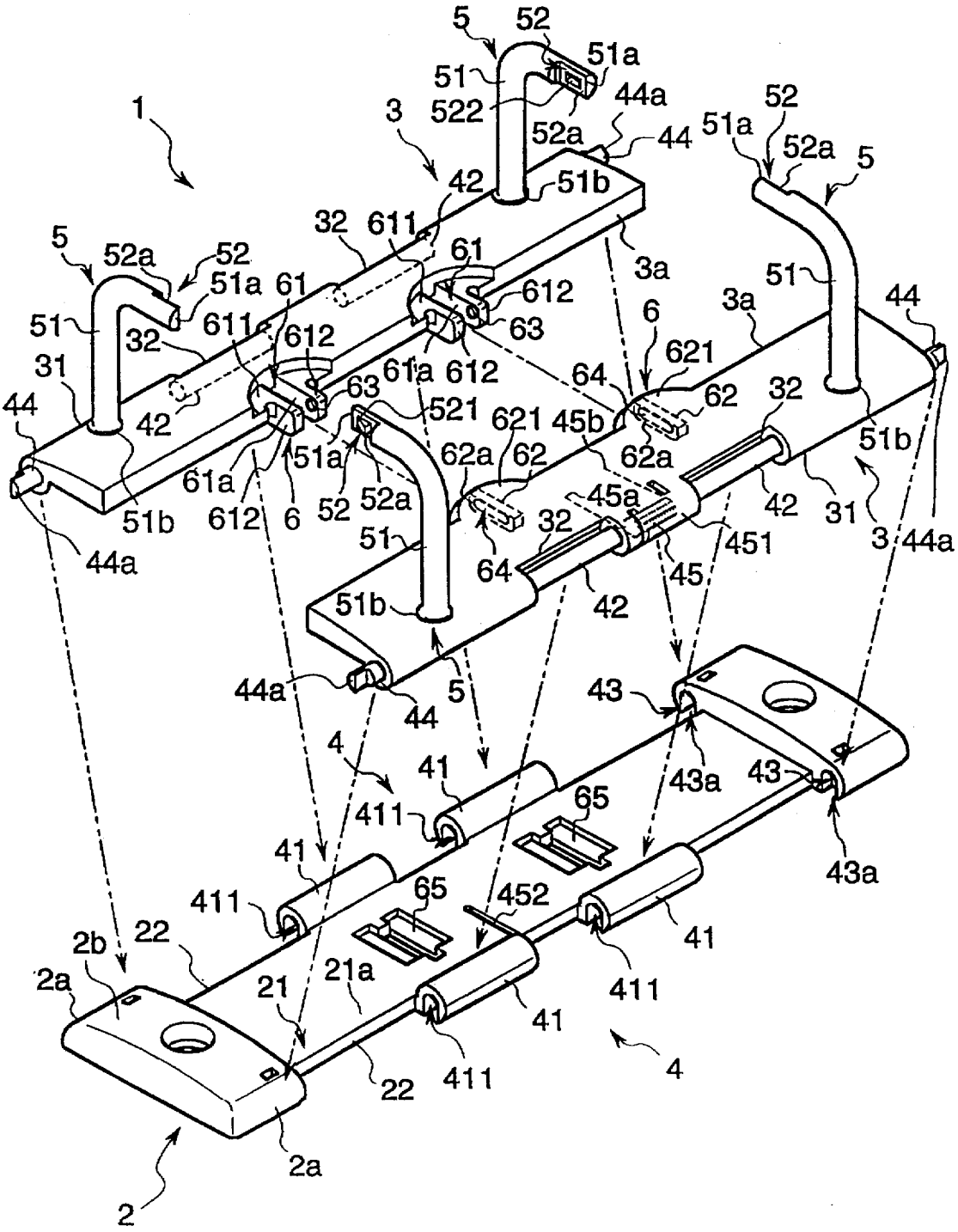
FIG. 2 is a exploded perspective view of the same embodiment.
Figure 3:
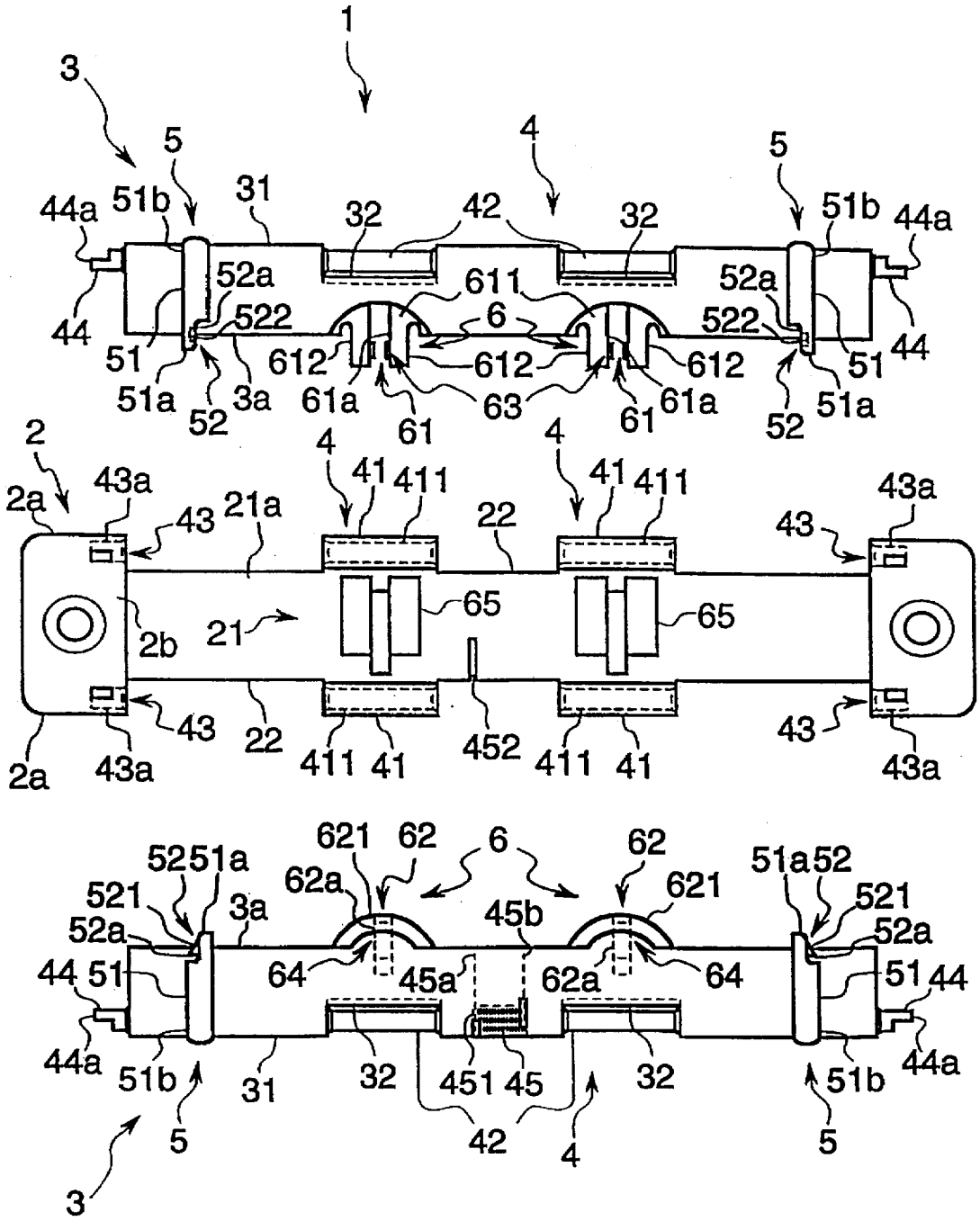
FIG. 3 is an exploded plan view of the same embodiment.

As shown in FIGS. 2 and 3, the fixed base plate 2 is of generally rectangular shape, having a recessed section 21 formed in its top face 2*b* for accommodating the swing base plates 3 when in their closed positions. The recessed section 21 has cut-out sections 22 formed along their longitudinal edges 2*a* by cutting inwardly in parallel.

A pair of swinging base plates 3 to be fitted within the recessed section 21 of the fixed base plate are of generally rectangular shape and of mirror image to each other, with their longitudinal lengths being approximately equal to that of the recessed section 21, with their widths approximately equal to half that of the recessed section 21, and with their thicknesses approximately equal to the depth of the recessed section 21. The swinging base plates 3 have formed along their bottom edges and at positions corresponding to the cut-out sections 22 of the fixed base plate 2 base end sections 31 of generally circular cross-section, and the binding rings 5 are attached upright on the top faces of the base end sections 31 at two locations.

Figure 4:
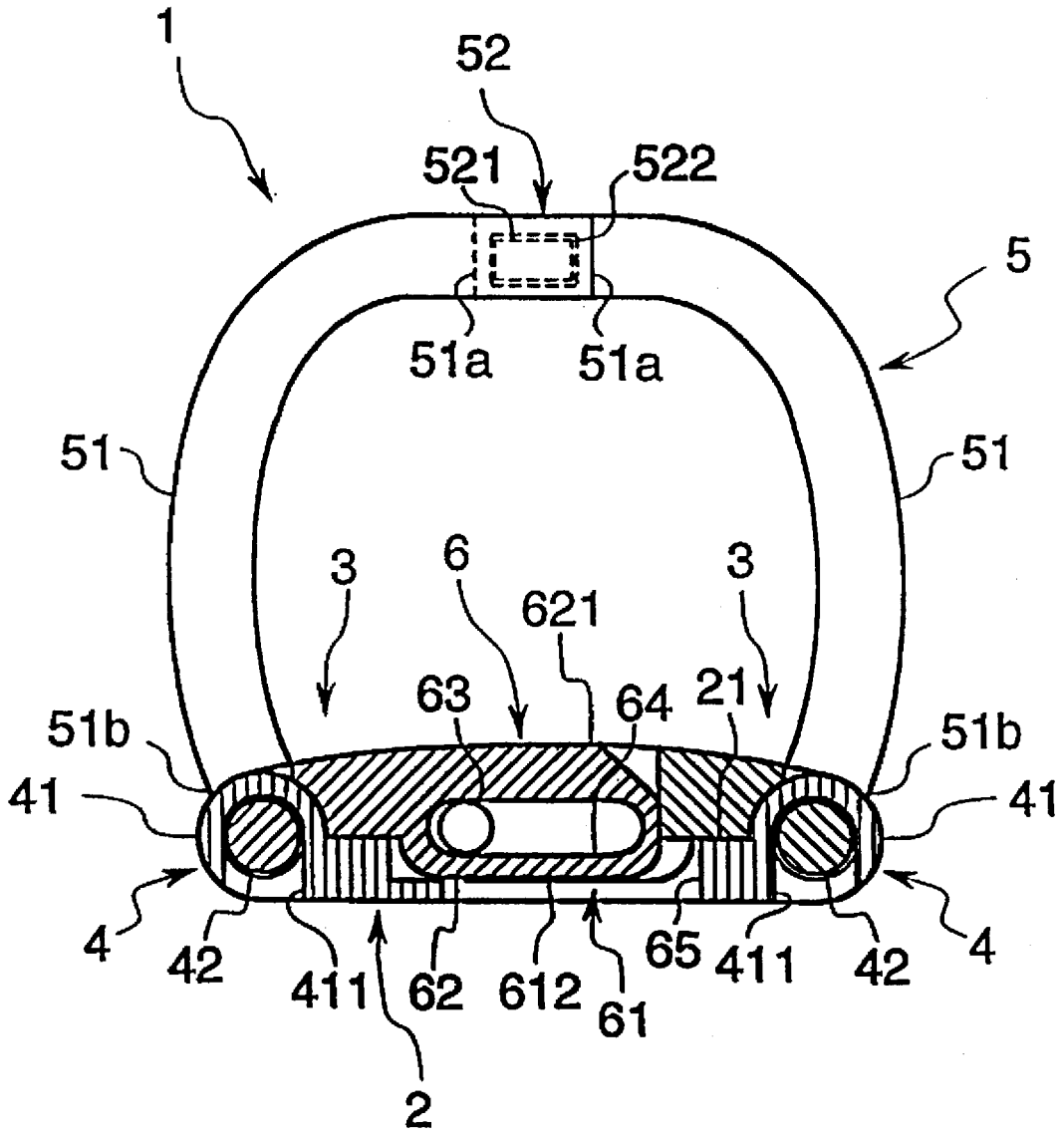
FIG. 4 is a cross-sectional view taken along the line 4—4 of FIG. 1 and showing a hinge mechanism, joint mechanism and binding ring of the same embodiment.

The hinge mechanism 4 comprises the first bearing sections 41 formed to extend outwardly at two center locations of the cut-out sections 22 of the fixed base plate 2, the first bearing shafts 42 formed on the base end sections 31 of the swing base plate 3 at positions corresponding to the first bearing sections 41, second bearing sections 43 formed in the longitudinal ends of the cut-out sections 22 of the fixed base plate 2, and the second bearing shafts 44 formed to extend from the longitudinal ends of the base end sections 31 of the swing base plates 3 at positions corresponding to the second bearing sections 43. As shown in FIG. 4, there are provided in the first bearing sections 41 longitudinal grooves 411, which are open downwardly. The first bearing shafts 42 are of circular cross-section, and are provided longitudinally along cut-out sections 32 made in the base end sections 31 of the swing base plate 3 at positions corresponding to the first bearing sections 41. The second bearing sections 43 extend longitudinally from the longitudinal ends of the recessed section 22 of the fixed base plate 2 and are open downwardly, with their open slots 43*a* being reduced to half in width toward the longitudinal ends of the second bearing sections 43. The second bearing shafts 44 are of cylindrical shape, slightly smaller in diameter than the second bearing sections 43 and, in accordance with the shape of the reduced slots 43*a*, the outer halves of the second bearing shafts 44 are cut away into a semi-circular cross-section so that the second bearing shafts 44 can be inserted into place within the second bearing sections 43 via the reduced slots 43*a* only when the swing base plates 3 are held in the positions shown in FIG. 5.

The binding rings 5 comprise a pair of ring halves 51 of generally semi-circular shape, which are joined together in closed position to form a ring-like configuration. The ring halves 51 are fixedly mounted at their bases 51*b* to the top faces of the swing base plates 3 at two locations near the end base sections 31, so that the ring halves 51 are opened when the top swing edges 3*a* of the swing base plates 3 move away from the top face 21*a* of the recessed section 21 in the fixed base plate 2, while they are closed when the top swing edges 3*a* move toward the top face 21*a* of the recessed section 21 in the fixed base plate 3*a*.

Figure 5:
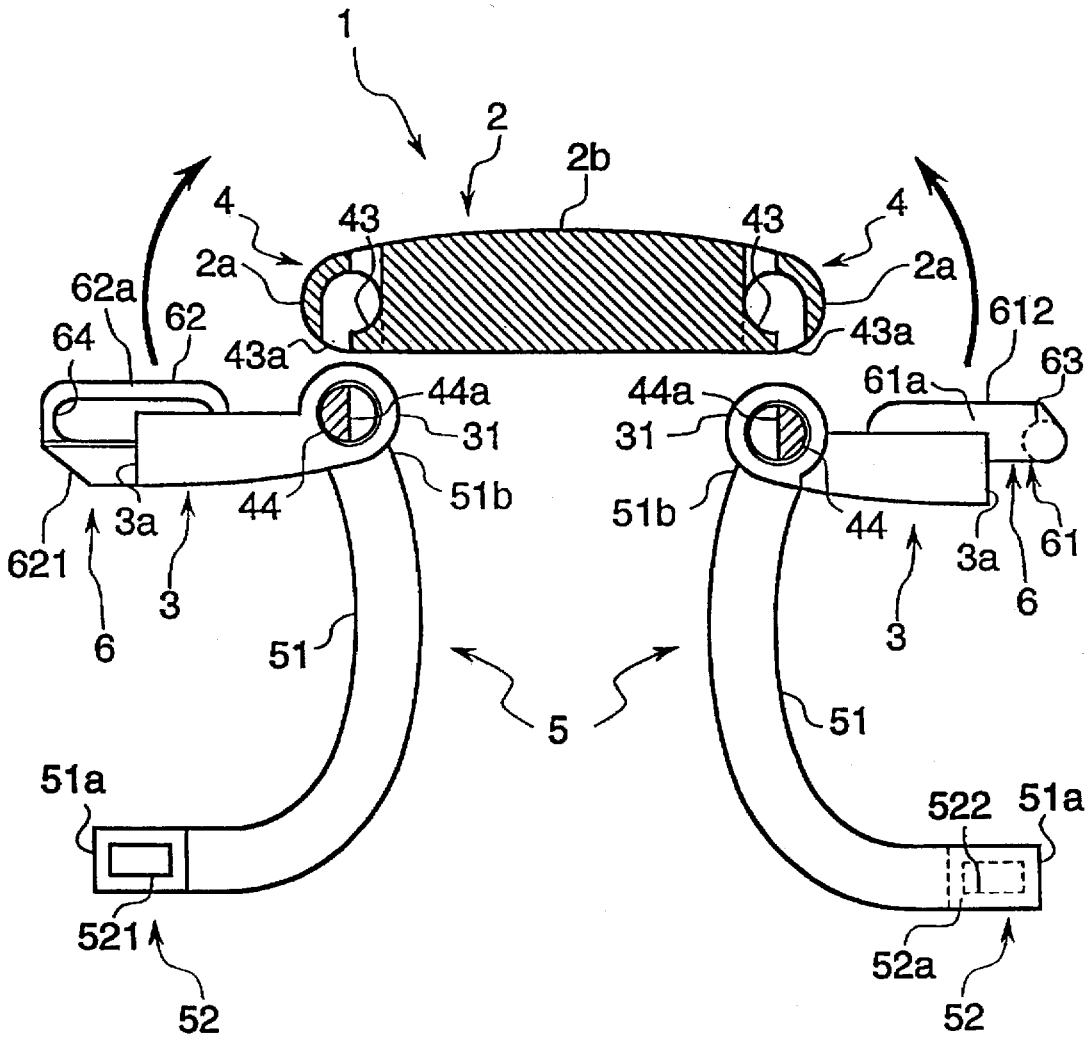
FIG. 5 is a cross-sectional view taken along the line 5—5 of FIG. 1 and showing a hinge mechanism and binding ring of the same embodiment.

The ring binder 1 of the above-described construction will be assembled together in the following procedure. First, as shown in FIG. 5, rotate and hold the swing base plates 3 below the fixed base plate 2 at a suitable angle with respect thereto to enable the second bearing shafts 44 to move through the reduced slots 43*a* in the bearing sections 43, then insert the second bearing shafts 44 upwardly into the second bearing sections 43, and the first bearing shafts 42 upwardly into the longitudinal grooves 411 of the first bearing sections 41, respectively, after which the swing base plates 3 are rotated to bring the top swing edges 3*a* into contact with top face 21*a* of the recessed section 21 in the fixed base plate 2, thereby closing the binding rings 5 with their locking ends 52 securely latched. Since the second bearing shafts 44 can be inserted into and removed from the second bearing sections 43 via the slots 43*a* only at the specific relative angle of the swing base plates 3 with respect to the fixed base plate 2, the swing base plates 3 are effectively prevented from inadvertently dropping off the fixed base plate 2.

Figure 6:
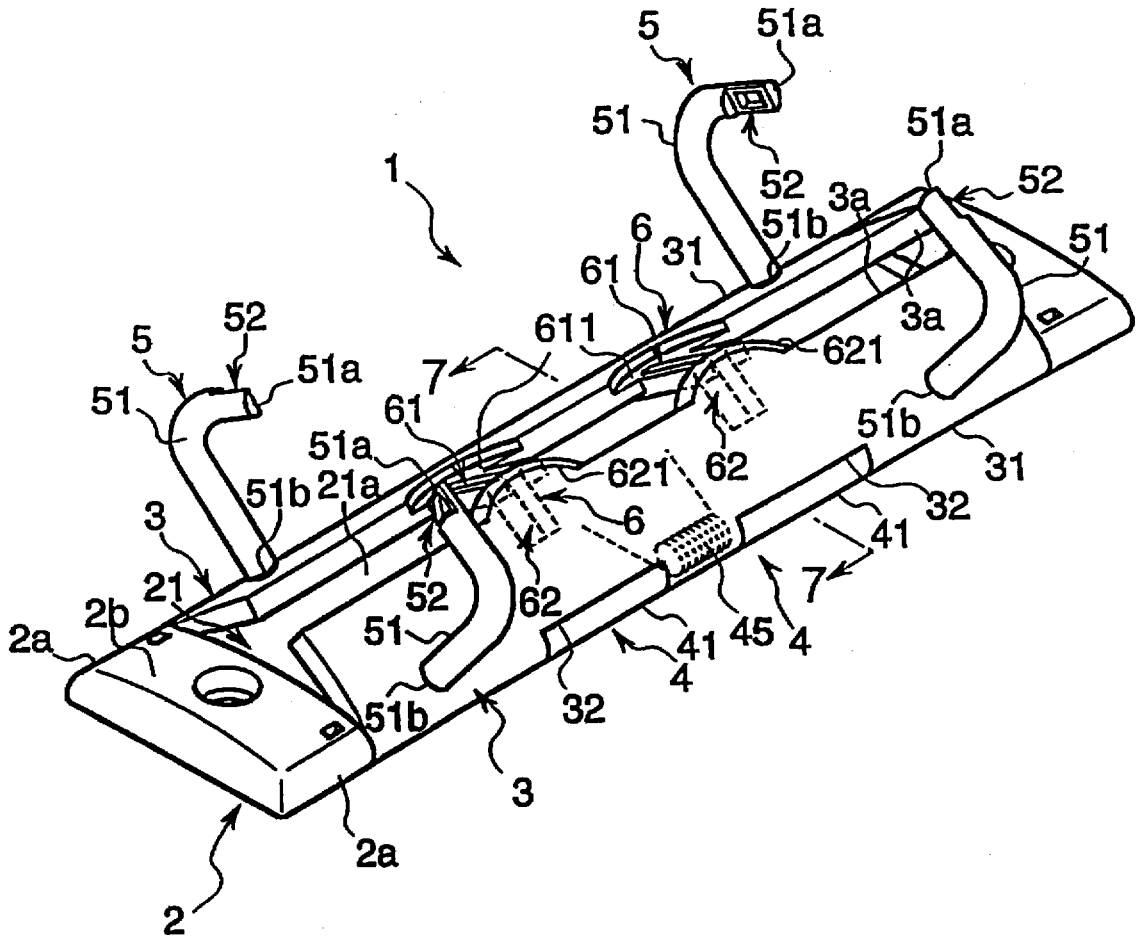
FIG. 6 is a perspective view of the same embodiment showing the operation of the joint mechanism.

In this embodiment of the ring binder 1 of the above-explained arrangement, as illustrated in FIG. 6, the opposing top edges 3*a* of the pair of the swing base plates 3 are joined together at the two locations near their longitudinal center by means of joint mechanisms 6, so that the pair of swing base plates 3 can swing up and down together to bring their opposing swing edges 3*a* into and out of contact with the top face 21*a* of the recessed section 21 in the fixed base plate 2. Also, one of the swing base plates 3 is provided with a resilient hinge mechanism 4 having a coil spring 45 incorporated therein. In addition, the opposing ring halves 51 of the binding rings 5 are so designed that their end portions are securely latched together by means of the interlocking ends 52.

Figure 7:
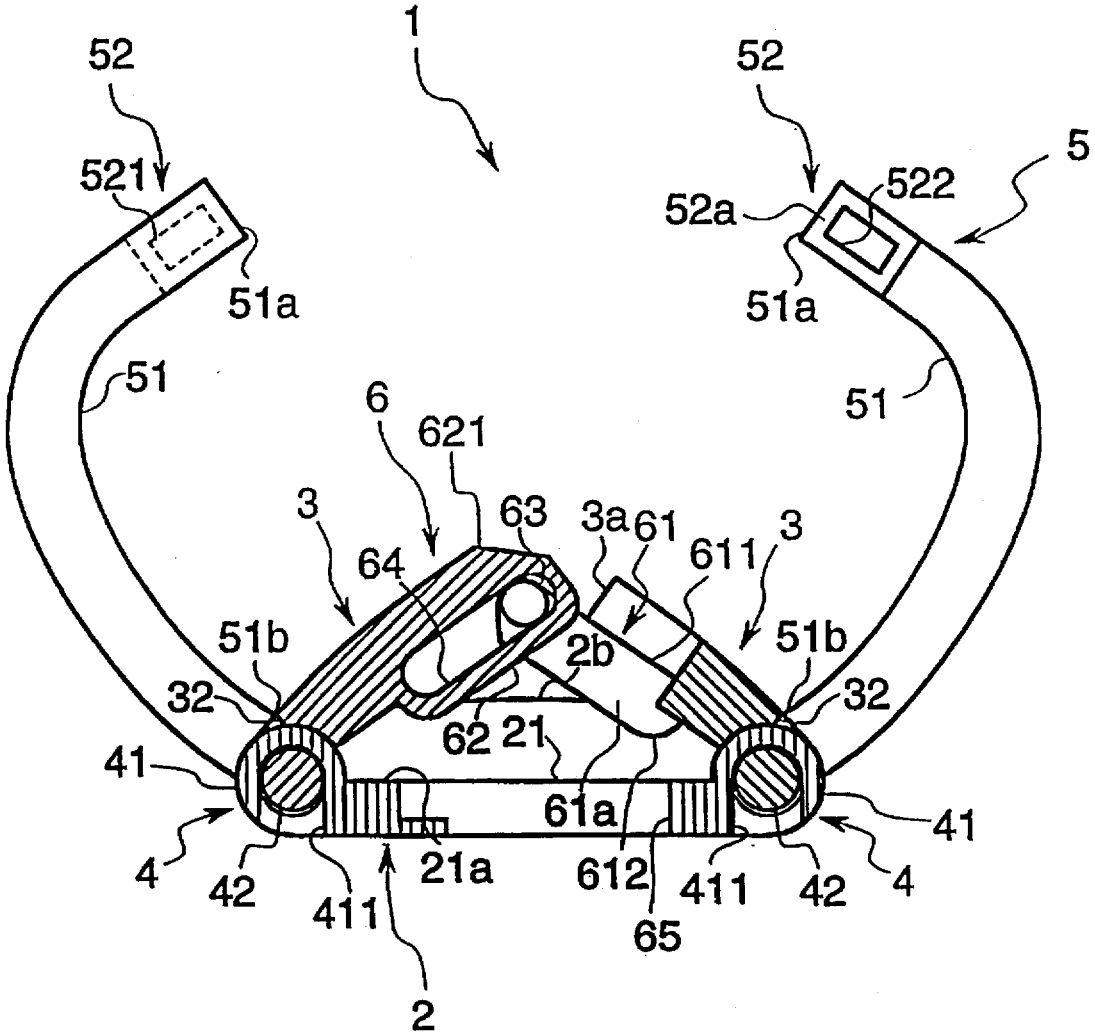
FIG. 7 is a cross-sectional view taken along the line 7—7 of FIG. 6 and showing the operation of the joint mechanism.

The joint mechanisms 6 for the swing base plates consists of female joint portions 61 integrally formed in the longitudinal swing edge 3*a* of one swing base plate 3 and male joint portions 62 similarly formed in the longitudinal swing edge 3*a* of the other base plate 3. The female joint portions 61 are provided between a pair of support bars 612 which are formed to extend outwardly from the semi-circular recesses 611 made along the longitudinal edges 3*a* of the swing base plates 3. The female joints 61 have pin-like engaging projections 63 made on the opposing side faces 61*a*. The mating male joints 62 are provided on the underside of the semi-circular protrusions 621 formed to extend outwardly from the longitudinal edges 3*a* of the swing base plates 3. The male joints 62 are also positioned at locations suitable for insertion into the female joints 61. The male joints 62 have mating slots 64 made in the side faces 62*a* to extend along their entire widths. In order to put the joint mechanism 6 together, insert the female joints 61 by force into their mating male joints 62, thereby snapping the projections 63 snugly into the slots 64 by means of resilient deformation of the female joints 61, which enables the sliding movement of the projections 63 within the mating slots 64. The relative position between the engaging projections 63 and mating slots 64 should be determined to make it possible for the opposing swing base plates 3 to move between a flat position as shown in FIG. 4 where both longitudinal edges 3*a* lie close to the top face 21*a* of the recessed sections 21 in the fixed base plate 2, and an inclined position as shown in FIG. 7 where both longitudinal edges 3*a* are upwardly away from the top face 21*a* of the recessed section 21 in the fixed base plate 2 and are slanted at approximately the same angle with respect to the fixed base plate 2. Also there are provided in the fixed base plate 2 sunk portions 65 at positions corresponding to the female joints 61 and the male joints 62 for accommodating both the female joints 61 and the male joints 62 when the longitudinal swing edges 3*a* of the swing base plate 3 are brought onto the top face 21*a* of the recessed section 21 in the fixed base plate 2.

The coil spring 45 is placed in a spring storage space 451 formed in the bottom edge sections 31 of one of the swing base plates 3 between the first bearing shafts 42, with one end 45*a* of the spring being in engagement with a spring support slit 452 provided in the top face 21*a* of the recessed section 21 in the fixed base plate 2, and other end 45*b* in contact with the undersides of the swing base plates 3, resulting in the longitudinal swing edges 3*a* of the swing base plates 3 being pushed away from the top face 21*a* of the recessed section 21 in the fixed base plate 2 by spring force.

The locking ends 52 of the ring halves 51 have their end portions 51*a* cut away in semi-circular cross-section to form cut-away surfaces 52*a*, and the cut-away surface 52*a* of one ring half 51 is provided with a locking projection 521, and the cut-away surface 52*a* of the other ring half 51 a locking recess 522. When the binding rings 5 are closed, the end portions 51*a* of the ring halves 51 come into engagement with each other at their cut-away surfaces 52*a* and, at the same time, the locking recess 521 and the locking projection 522 are brought into locking engagement.

The ring binder 1 of the above-described arrangement operates in use as follows. When it is intended to close the binding rings 5, push down only one swing base plate 3 to bring its longitudinal edge 3*a* closer into contact with the top face 21*a* of the recessed section 21 in the fixed base plate 2, which simultaneously brings the longitudinal edge 3*a* of the other swing base 3 closer into contact with the top face 21*a* of the recessed section 21 in the fixed base plate 2 by the operation of the joint mechanism 6. As a result, the end portions 51*a* of the ring halves 51 are brought into engagement with each other and are locked together by the locking ends 52, thereby holding the binding rings 5 in their closed position. It should be noted that, with the binding rings 5 in the closed position, the semi-circular protrusions 621 of one swing base plate 3 fit into the mating semi-circular recesses 611 of the other swing base plate 3 in overlapping relation, thus holding the female joints 61, the male joints 62, engaging projections 63 and the mating slots 64 of the joint mechanism 6 invisible to sight, which means that the joint mechanisms 6 does not have an adverse effect on the appearance of the ring binder. On the other hand, when it is intended to open the binding rings 5, just unlock or disengage the locking ends 52. Upon unlocking the locking ends, that swing base plate 3 which is being biased by the coil spring 45 is pushed upward to move its longitudinal edge 3*a* away from the top face 21*a* of the recessed section 21 in the fixed base plate 2, which at the same time causes the longitudinal edge 3*a* of the other swing base plate 3 to move away from the top face 21*a* of the recessed sections 21 in the fixed base plate 2 through the operative engagement by means of the joint mechanism. As a result, the binding rings 5 are brought into their open position.

With the arrangement of the ring binder 1 explained above, since both of the swing base plates 3 rotate back and forth simultaneously through the operative engagement via the joint mechanism 6, the opening and closing operation of the binding rings 5 can be effected only by manipulating either one of the swing base plates 3, which makes it possible to open and close the rings in one-touch operation with one hand, thereby leading to much easier operation. Furthermore, the joint mechanisms 6 effectively link the two opposing longitudinal swing edges 3*a* of the swing base plates 3 in operative engagement by means of the projections 63 slidably fitted into the mating slots 64. This is effective in providing the above operation in a simple arrangement, making it possible to reduce both manufacturing costs and manufacturing processes. The fact that the male joints 62 slidably move within the female joints 61 as the swing base plates 3 rotate back and forth is effective in greatly reducing the longitudinal offset in the position of the pair of the swing base plates 3 by means of the operative engagement between the side faces 61*a* of the female joints 61 and the side faces 62*a* of the male joints 61, which, in turn, ensures a steady opening and closing operation of the binding rings 5 even if the mounting accuracy of the swing base plates 3 is rather low. Also, the fact that the engaging projections 63 and the mating slots 64 are provided in the female joints 61 and the male joints 62, respectively, enables to achieve the above advantages with the simplest arrangement on one hand, and leads to the joint mechanism in compact size. In addition, the unique arrangement in which the opposing ring halves 51 of the binding rings 5 are locked together in mutual engagement via the locking ends 52 eliminates the necessity to hold the binding rings 5 in their closed position by means of the joint mechanism 6, which results in a simple arrangement and easy manipulation.

Figure 8:
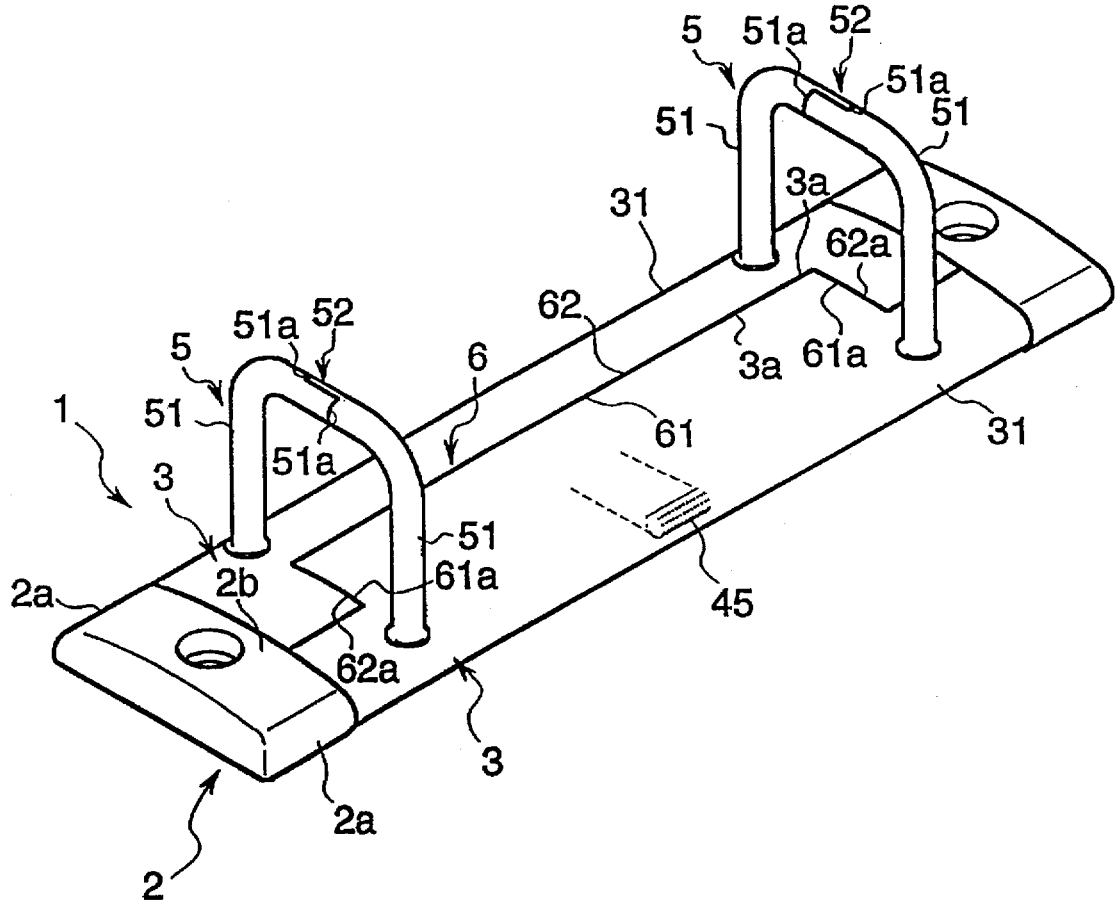
FIG. 8 is a perspective view showing another embodiment of the present invention.
Figure 9:
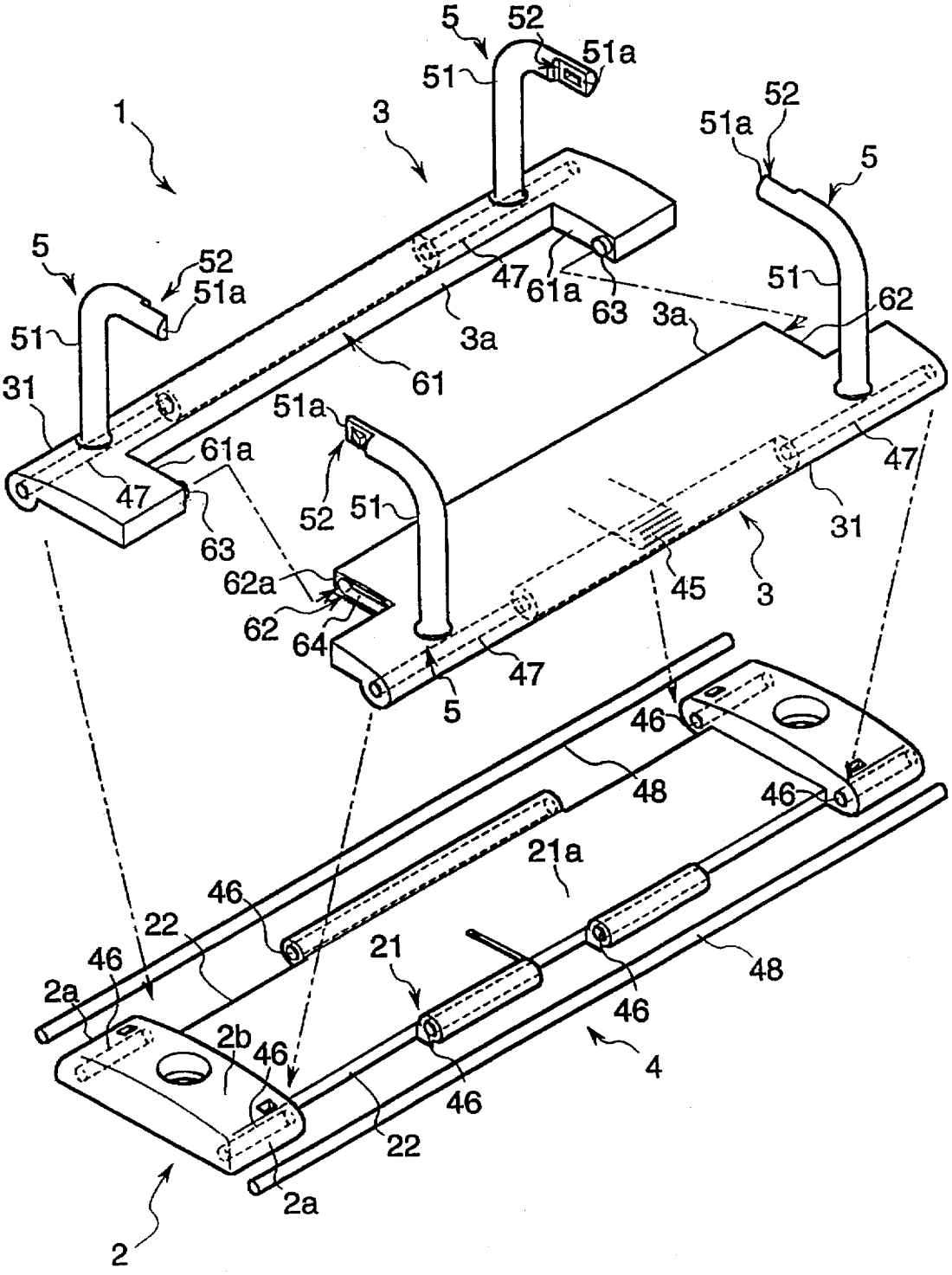
FIG. 9 is an exploded plan view of the second embodiment.
Figure 10:
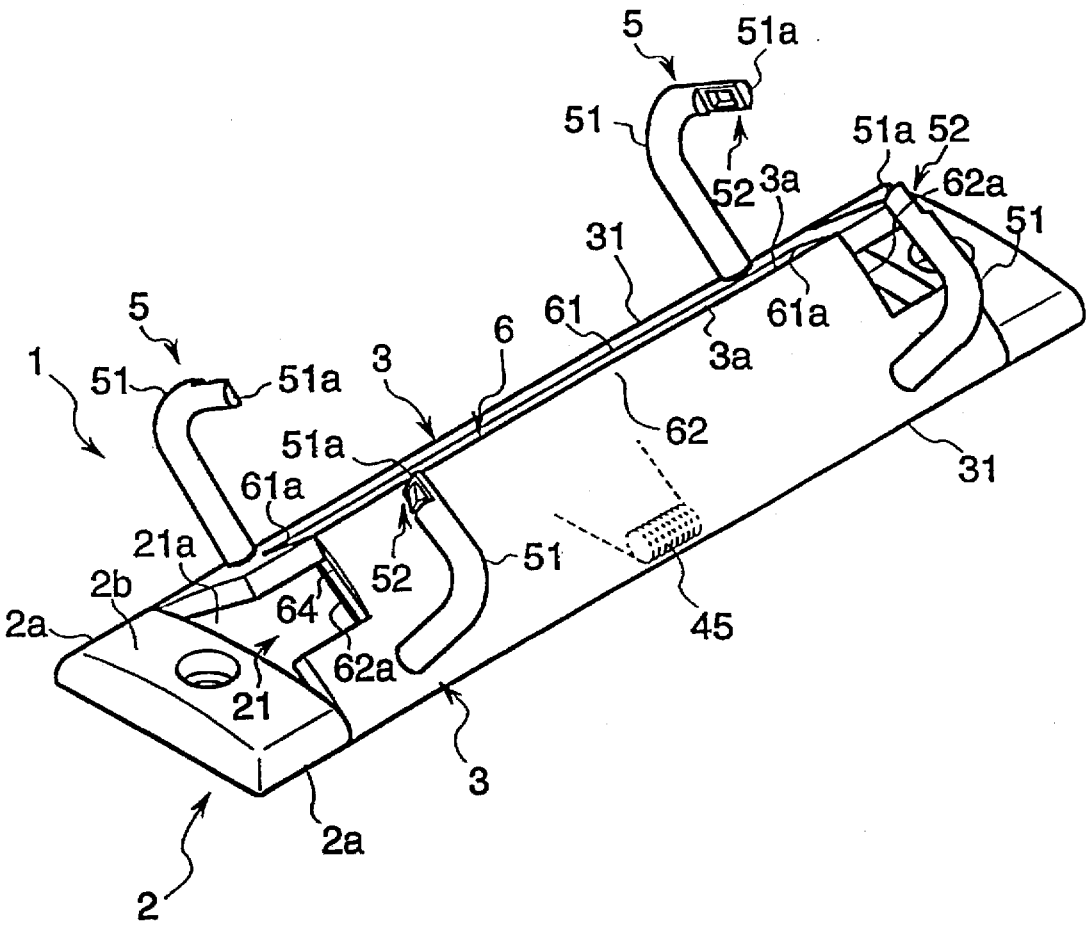
FIG. 10 is a perspective view of the second embodiment showing the operation of the joint mechanism.

In another embodiment of the invention, as shown in FIG. 8, the opposing swing edges 3*a* of the pair of swing base plates 3 are connected by a joint mechanism 6 at two locations near their longitudinal ends. In the ring binder 1 of this embodiment, as shown in FIG. 9, the opposing base plates 3 are rotatably pivoted onto the fixed base plate 2 along their longitudinal edges 2*a* by means of a hinge mechanism 4, which comprises the first axial through-holes 46 formed to extend longitudinally along the both edges 2*a* of the fixed base plate 2, the axial through-holes 47 formed to extend longitudinally along the bottom edges 31 of the swing base plate 3 in line with the first axial through-holes 46, and elongated pins 48 to be inserted into the first and second axial through-holes 46 and 47. As illustrated in FIG. 10, the binding rings 5 fixedly attached on the swing base plates 3 move between their open and closed positions when the opposing swing base plates 3 are rotated back and forth.

The joint mechanism 6 of the present ring binder 1 consists of a recessed joint section 61 formed by cutting away one of the swing base plates 3 along its top longitudinal edge 3*a* except for the both ends, and extended joint section 62 formed along the top longitudinal edge 3*a* of the other swing base plate 3 at a position matching to the recessed joint section 61. The recessed joint section 61 has male engagement projections 63 made to extend from its lateral side faces 61*a*. The extended joint section 62 has mating female engagement slots 64 formed to extend sideways along its lateral side faces 62*a*. In order to assemble the joint mechanism 6, the extended joint section 62 is fitted into the recessed joint sections 61, forcing the male projections 63 into the female slots 64, by means of resilient deformation of the recessed joint sections 61, for a sliding movement within the slots. It is possible to obtain advantages similar to those of the previous embodiment.

It is apparent that the arrangement of the present invention is not limited to those explained in detail hereinabove. For example, any number of joint mechanisms, binding rings and hinge mechanisms may be employed to advantage. Also, the form and arrangement of the joint mechanism are not necessarily limited to those of the embodiments described above. For example, it is possible to provide a female joint in the recessed joint section, and a male joint in the extended joint section. It is also possible to provide the recessed joint section and the extended joint section near the center of the swinging top longitudinal edges of the swing base plates, and the male joints and the female joints at the longitudinal ends of the top swinging edges, respectively. In still another arrangement, metal plates may be provided to extend from the longitudinal ends of one swing base plate, and extended sections are made in the faces opposite to the metal plates, thereby forming male engagement, while grooves are made at the longitudinal ends of the other swing base plate forming a female engagement. When the above projections are fitted in the above slots for sliding movement, and the above metal plates are provided at the longitudinal ends of the other swing base plate, the metal plates function as a female joint and the other swing base plate a male joint. Many other modifications can be made without departing from the scope of the invention.

INDUSTRIAL APPLICABILITY

As apparent from the foregoing description, the ring binder of the present invention is effectively utilized to removably bind together separate sheets with binding holes such as loose leaves, paper sheets for adhesively attaching photographs.

I claim:

1. A ring binder comprising a fixed plate having a top face, a pair of swing plates each having an outer swing edge and an inner edge and each plate being pivotally attached at said inner edge by a hinge mechanism to a longitudinal edge of said fixed plate, binding rings fixedly mounted on said swing plates, said binding rings being closed when the swing edges of said swing plates pivot toward the top face of said fixed plate, and said binding rings being opened when the swing edges of said swing plates pivot away from the top face of said fixed plate, characterized in that the swing edges of said pair of swing plates are linked together by a joint mechanism such that said pair of swing plates move together toward and away from the top face of said fixed plate, and that said joint mechanism comprises a protruding joint section formed in the swing edge of one of said swing plates and a recessed joint section formed in the swing edge of the other swing plate, each swing plate including side faces, said side faces in the protruding joint section being opposed to the side faces of the recessed joint section, said joint mechanism including a narrow elongated slot extending toward the swing edge integrally formed on one of said side faces of said joint section and a projection having a diameter approximately equal to the width of said slot integrally formed on the opposing side face, such projection being slidably engaged within said slot.

2. A ring binder as defined in claim 1, wherein said binding ring comprises a pair of opposing ring halves, each fixedly mounted at one end onto a swing plate at an edge near the longitudinal edge of said fixed plate, said ring halves having engaging means at a second unmounted end so that the ends of said opposing ring halves are joined together by said engaging means when said binding rings are closed.

3. A ring binder as defined in claim 1, wherein said hinge mechanism on each of said swing plates is provided with spring means, said spring means resiliently biasing said swing plate so that said swing edge of said swing plate is pushed away from the top face of said fixed plate.

4. A ring binder as defined in claim 3, wherein said binding ring comprises a pair of opposing ring halves, each fixedly mounted at one end onto said swing plates at an edge near the longitudinal edge of said fixed plate, said ring halves having engaging means at a second unmounted end so that the ends of said opposing ring halves are joined together by said engaging means when said binding rings are closed.

* * * * *